US008608030B2

(12) United States Patent
Vogt et al.

(10) Patent No.: US 8,608,030 B2
(45) Date of Patent: Dec. 17, 2013

(54) CARTRIDGE SYSTEM WITH COMPRESSED GAS CARTRIDGE

(75) Inventors: Sebastian Vogt, Erfurt (DE); Hubert Büchner, Nürnberg (DE); Tim Schnieber, Frankfurt (DE)

(73) Assignee: Heraeus Medical GmbH, Wehrheim (DE)

( * ) Notice: Subject to any disclaimer, the term of this patent is extended or adjusted under 35 U.S.C. 154(b) by 155 days.

(21) Appl. No.: 13/096,156

(22) Filed: Apr. 28, 2011

(65) Prior Publication Data

US 2011/0272433 A1 Nov. 10, 2011

(30) Foreign Application Priority Data

May 4, 2010 (DE) ..... 10 2010 019 223

(51) Int. Cl.
*B67D 7/70* (2010.01)

(52) U.S. Cl.
USPC ..... 222/137; 222/5; 222/145.5

(58) Field of Classification Search
USPC ..... 222/389, 399, 391, 387, 325, 326, 327, 222/386, 394, 83, 83.5, 88, 81, 5, 397, 188, 222/484, 94, 160, 153.11, 478, 82, 373, 3, 222/4, 135, 136, 137, 138, 393.1, 385, 222/145.1, 145.5, 145.6, 372, 378, 380
See application file for complete search history.

(56) References Cited

U.S. PATENT DOCUMENTS

| | | | | |
|---|---|---|---|---|
| 1,092,433 A | | 4/1914 | Cox | |
| 1,308,091 A | | 7/1919 | Maurer | |
| 1,920,165 A | * | 8/1933 | Andvig | 222/80 |
| 2,125,245 A | | 7/1938 | McCray | |

(Continued)

FOREIGN PATENT DOCUMENTS

| | | |
|---|---|---|
| AU | 653201 B2 | 9/1994 |
| CH | 669164 A5 | 2/1989 |

(Continued)

OTHER PUBLICATIONS

European Search Report Dated Sep. 13, 2011 for EP 11 00 3139 corresponding to U.S. Appl. No. 13/096,133.

(Continued)

*Primary Examiner* — Kevin P Shaver
*Assistant Examiner* — Michael J Melaragno
(74) *Attorney, Agent, or Firm* — Norris McLaughlin & Marcus, P.A.

(57) ABSTRACT

Cartridge systems for application of a material have at least one cartridge having cartridge walls, a cartridge head having at least one opening in the cartridge head, and a bracket arranged on the cartridge head. A valve is mounted in rotatable manner in the bracket and has at least one passage through the valve that is connected to an outlet opening of the valve. In a closed position, the valve closes the at least one opening of at least one cartridge in a sealed manner. The at least one passage of the valve is connected to the at least one opening when the valve is located in an open position such that the cartridge content is squeezable out of the at least one cartridge through the outlet opening, and further wherein the valve is configured to be transitioned from a closed position to an open position through a rotation of the valve about an axis of symmetry of the valve.

18 Claims, 3 Drawing Sheets

(56) References Cited

U.S. PATENT DOCUMENTS

| | | | | |
|---|---|---|---|---|
| 2,446,501 | A | 8/1948 | Weber | |
| 2,694,506 | A | 11/1954 | Knapp | |
| 2,818,899 | A | 1/1958 | De Back | |
| 2,973,885 | A * | 3/1961 | Ferguson | 222/399 |
| 3,116,856 | A | 1/1964 | Prussin et al. | |
| 3,215,298 | A | 11/1965 | Shaffer | |
| 3,570,719 | A | 3/1971 | Schiff | |
| 3,752,368 | A | 8/1973 | Robertson | |
| 3,768,472 | A | 10/1973 | Hodosh et al. | |
| 3,834,433 | A * | 9/1974 | Thompson | 141/392 |
| 3,938,709 | A | 2/1976 | Collar | |
| 3,983,947 | A | 10/1976 | Wills et al. | |
| 4,068,830 | A | 1/1978 | Gray | |
| 4,318,403 | A | 3/1982 | Sneider | |
| 4,386,717 | A * | 6/1983 | Koob | 222/94 |
| 4,432,469 | A | 2/1984 | Eble et al. | |
| 4,441,629 | A | 4/1984 | Mackal | |
| 4,690,306 | A | 9/1987 | Staheli | |
| 4,846,373 | A | 7/1989 | Penn et al. | |
| 4,848,598 | A | 7/1989 | McKinney | |
| 4,871,088 | A | 10/1989 | Cox | |
| 4,925,061 | A | 5/1990 | Jeromson, Jr. et al. | |
| 4,967,797 | A | 11/1990 | Manska | |
| 4,981,241 | A | 1/1991 | Keller | |
| 4,989,758 | A | 2/1991 | Keller | |
| 5,027,981 | A | 7/1991 | Magister | |
| 5,072,862 | A | 12/1991 | Keller | |
| 5,080,262 | A * | 1/1992 | Herold et al. | 222/135 |
| 5,137,182 | A | 8/1992 | Keller | |
| 5,156,421 | A | 10/1992 | Chauvel | |
| 5,301,631 | A * | 4/1994 | Vining | 116/210 |
| 5,301,842 | A | 4/1994 | Ritter | |
| 5,441,175 | A | 8/1995 | Jacobsen et al. | |
| 5,443,182 | A * | 8/1995 | Tanaka et al. | 222/137 |
| 5,477,987 | A | 12/1995 | Keller | |
| 5,498,078 | A | 3/1996 | Keller | |
| 5,514,135 | A | 5/1996 | Earle | |
| 5,566,860 | A * | 10/1996 | Schiltz et al. | 222/94 |
| 5,667,102 | A | 9/1997 | Keller | |
| 5,890,628 | A | 4/1999 | Simpson et al. | |
| 5,893,486 | A | 4/1999 | Wasmire | |
| 5,894,869 | A | 4/1999 | Mussack | |
| 5,944,226 | A | 8/1999 | Schiltz et al. | |
| 5,968,018 | A | 10/1999 | Freeman et al. | |
| 6,029,857 | A | 2/2000 | Keller | |
| 6,077,138 | A * | 6/2000 | Schulze | 441/40 |
| 6,296,149 | B1 * | 10/2001 | Long | 222/82 |
| 6,311,871 | B1 | 11/2001 | Binder | |
| 6,547,101 | B1 * | 4/2003 | Sogaro | 222/137 |
| 6,783,509 | B1 | 8/2004 | Landau et al. | |
| 6,935,541 | B1 * | 8/2005 | Campbell et al. | 222/380 |
| 7,163,130 | B2 | 1/2007 | Lafond | |
| 7,185,792 | B2 | 3/2007 | Gibbons et al. | |
| 7,188,753 | B2 | 3/2007 | Campbell | |
| 7,481,333 | B2 * | 1/2009 | Goldberg et al. | 222/135 |
| 7,530,808 | B2 | 5/2009 | Cao et al. | |
| 7,637,398 | B2 | 12/2009 | Sung | |
| 7,677,418 | B2 | 3/2010 | Henniges et al. | |
| 7,752,974 | B2 * | 7/2010 | Wenaas et al. | 102/367 |
| 7,845,517 | B2 | 12/2010 | Py et al. | |
| 7,963,937 | B2 | 6/2011 | Pauser et al. | |
| 8,016,161 | B2 | 9/2011 | Pierson et al. | |
| 8,028,858 | B2 | 10/2011 | Hollars | |
| 8,177,099 | B2 | 5/2012 | Suchan et al. | |
| 8,292,619 | B2 | 10/2012 | Peuker et al. | |
| 8,328,553 | B2 | 12/2012 | Broyles et al. | |
| 2001/0008968 | A1 | 7/2001 | Overes et al. | |
| 2002/0052579 | A1 * | 5/2002 | Sogaro | 604/218 |
| 2002/0188250 | A1 | 12/2002 | Landau et al. | |
| 2003/0179648 | A1 | 9/2003 | Heusser et al. | |
| 2004/0074927 | A1 | 4/2004 | Lafond et al. | |
| 2004/0104249 | A1 | 6/2004 | Horth et al. | |
| 2004/0216591 | A1 | 11/2004 | Assadi et al. | |
| 2005/0150916 | A1 | 7/2005 | De Laforcade | |
| 2005/0230433 | A1 | 10/2005 | Campbell | |
| 2005/0241703 | A1 | 11/2005 | Takacs | |
| 2005/0247740 | A1 | 11/2005 | Puzio et al. | |
| 2005/0269368 | A1 | 12/2005 | Proulx | |
| 2006/0208000 | A1 | 9/2006 | Murray et al. | |
| 2007/0051750 | A1 | 3/2007 | Suchan et al. | |
| 2007/0164047 | A1 | 7/2007 | Reidt et al. | |
| 2007/0175921 | A1 | 8/2007 | Keller | |
| 2008/0086079 | A1 | 4/2008 | Williamson et al. | |
| 2008/0210708 | A1 | 9/2008 | Yesmes | |
| 2008/0247262 | A1 | 10/2008 | Henniges et al. | |
| 2008/0287880 | A1 * | 11/2008 | Keller | 604/191 |
| 2008/0304355 | A1 | 12/2008 | Sattig et al. | |
| 2008/0314929 | A1 | 12/2008 | Keller | |
| 2009/0057338 | A1 | 3/2009 | Knee et al. | |
| 2009/0062808 | A1 | 3/2009 | Wolf, II | |
| 2009/0065532 | A1 | 3/2009 | Lafond | |
| 2009/0071459 | A1 | 3/2009 | Wenaas et al. | |
| 2009/0105144 | A1 | 4/2009 | Vogt et al. | |
| 2009/0105366 | A1 | 4/2009 | Vogt et al. | |
| 2010/0200618 | A1 | 8/2010 | Dubach | |
| 2010/0319796 | A1 | 12/2010 | Whitaker | |
| 2011/0272436 | A1 * | 11/2011 | Vogt et al. | 222/145.5 |
| 2011/0272438 | A1 * | 11/2011 | Vogt et al. | 222/389 |

FOREIGN PATENT DOCUMENTS

| | | | |
|---|---|---|---|
| DE | 2017292 | A1 | 10/1971 |
| DE | 3440893 | A1 | 5/1986 |
| DE | 3530212 | C1 | 10/1986 |
| DE | 91 02 635 | U1 | 5/1991 |
| DE | 9102635 | U1 | 7/1991 |
| DE | 297 09 383 | U1 | 10/1998 |
| DE | 20107507 | U1 | 3/2002 |
| DE | 202005010206 | | 9/2005 |
| DE | 20 2006 014087 | U1 | 12/2006 |
| DE | 102005041961 | A1 | 3/2007 |
| DE | 102006001056 | A1 | 7/2007 |
| DE | 202006015457 | U1 | 2/2008 |
| DE | 20 2008 009692 | U1 | 10/2008 |
| DE | 102007044983 | A1 | 4/2009 |
| DE | 102007052116 | A1 | 4/2009 |
| DE | 102007050762 | A1 | 5/2009 |
| DE | 102008030312 | A1 | 1/2010 |
| EP | 0028032 | A1 | 5/1981 |
| EP | 0169533 | A2 | 1/1986 |
| EP | 0213073 | A1 | 3/1987 |
| EP | 0236129 | A2 | 9/1987 |
| EP | 0261466 | A1 | 3/1988 |
| EP | 0289882 | A1 | 11/1988 |
| EP | 0294672 | | 12/1988 |
| EP | 0431347 | | 6/1991 |
| EP | 0607102 | A1 | 7/1994 |
| EP | 0664153 | A1 | 7/1995 |
| EP | 0693437 | A1 | 1/1996 |
| EP | 0787535 | A1 | 8/1997 |
| EP | 1118313 | A1 | 7/2001 |
| EP | 2008707 | | 12/2008 |
| FR | 650 157 | A | 1/1929 |
| GB | 1188516 | A1 | 4/1970 |
| GB | 2195713 | A | 4/1988 |
| JP | 2003341749 | A | 12/2003 |
| JP | 2005289470 | A | 10/2005 |
| JP | 2009529377 | A | 8/2009 |
| JP | 2009 291234 | A | 12/2009 |
| WO | 2006005206 | A1 | 1/2006 |
| WO | 2008100130 | A2 | 8/2008 |
| WO | 2008109439 | | 9/2008 |
| WO | 2009036962 | A2 | 3/2009 |
| WO | 2009/061884 | A1 | 5/2009 |
| WO | 2010006455 | A1 | 1/2010 |

OTHER PUBLICATIONS

European Search Report Dated Sep. 15, 2011, for EP 11 00 3130 corresponding to U.S. Appl. No. 13/096,105.

"Australian Search Report dated Jul. 28, 2012 for AU Application No. 2011201857 corresponding to related U.S. Appl. No. 13/096,260."

Canadian Intellectual Property Office, Office Action dated Aug. 1, 2012.

(56) References Cited

OTHER PUBLICATIONS

Australian Search Report for related AU 2011202037, mailed Aug. 16, 2012.
Chinese Office Action for co-pending U.S. Appl. No. 13/096,156 for related Chinese Application No. 201110113264.4 dated Feb. 4, 2013.
U.S. Appl. No. 13/096,233, filed Apr. 28, 2011, not yet published.
U.S. Appl. No. 13/096,105, filed Apr. 28, 2011, not yet published.
U.S. Appl. No. 13/096,260, filed Apr. 28, 2011, not yet published.
U.S. Appl. No. 13/096,062, filed Apr. 28, 2011, not yet published.
Japanese Office Action for corresponding JP Application No. 2011-103862 dated Jul. 29, 2013 with English-Language Translation.
Non-Final Rejection from related U.S. Appl. No. 13/096,260, mailed Jul. 10, 2013.
Notice of Allowance from related U.S. Appl. No. 13/096,233, mailed Aug. 1, 2013.
Final Rejection from related U.S. Appl. No. 13/096,105, mailed Aug. 28, 2013.
Non-Final Rejection from related U.S. Appl. No. 13/096,062, mailed Sep. 5, 2013.

* cited by examiner

CARTRIDGE SYSTEM WITH COMPRESSED GAS CARTRIDGE

The present invention relates to a cartridge system for application of a flowable material, in particular a medical cement, comprising at least one cartridge, whereby the at least one cartridge comprises cartridge walls, one cartridge head each, and one feed plunger opposite the cartridge head each for expelling a cartridge content, whereby the cartridge (s) comprise(s) at least one opening in the cartridge head or the cartridge wall that can be closed through a valve.

Cartridge systems for mixing and applying a mixing ware can consist of multiple components and are to ensure safe storage and safe closure for components in at least two cartridges prior to their use. The cartridge system should be safe and easy to open right before the application of the mixing ware, whereby synchronous opening of the individual cartridges is desirable.

BACKGROUND OF THE INVENTION

Reactive pasty two- or multi-component systems must be stored separately after their production and until their application in order to prevent premature, inadvertent reactions of the components. Cartridge systems for the application of pasty two- or multi-component systems have been known for decades. The following documents are cited for exemplary purposes, CH 669 164 A5, EP 0 607 102 A1, EP 0 236 129 A2, DE 3 440 893 A1, U.S. Pat. No. 4,690,306 A, US 2009/062808 A1, EP 0 787 535 A1, WO 2006/005 206 A1, EP 0 693 437 A1, EP 0 294 672 A, EP 0 261 466 A1, and EP 2 008 707 A1. After the cartridges are filled with reactive pastes, the cartridges need to remain safely closed until their application. The pasty two- or multi-component systems are mixed right before their application, usually through the use of static mixers. In this context, the following documents are cited for exemplary purposes, GB 1,188,516 A, U.S. Pat. No. 2,125,245 A, U.S. Pat. No. 5,968,018 A, U.S. Pat. No. 4,068,830 A, US 2003/179648 A1, EP 0 664 153 A1, and EP 0 289 882 A1. In this context, mobile plungers seal the cartridge floors and are subsequently used to squeeze out the pastes during their application.

A number of solutions has been proposed for closing the cartridge system head of the cartridge system.

One simple, but very effective, principle is to close the cartridge head with a closure that can be rotated (EP 0 431 347 A1, DE 2 017 292 A1, U.S. Pat. No. 3,215,298 A). The closure is unscrewed prior to the application. Subsequently, a dispensing tube is screwed into a thread on the cartridge head or fixed through a peg system that simulates a thread. This is disadvantageous in that the user needs to perform rotational motions twice until the paste material can be expelled. Moreover, the closure may be screwed out and the dispensing tube is attached only later. In the interim between the cartridges being opened and the dispensing tube being inserted, ingredients of the pastes may evaporate, especially if the pastes contain volatile substances.

The closure that is in very common use currently in the adhesives and sealant industry is based on the wall material of the cartridge being provided to be very thin at the cartridge head such that said wall can be perforated easily. During perforation, particles become detached from the wall and can thus enter the pasty material.

A further cartridge system is based on packaging pasty multi-component systems in tubular bags (WO 2010/006455 A1). This involves inserting the sealed tubular bags into cartridges. Tubular bags are advantageous in that they are suitable for packaging pastes that contain volatile ingredients. Tubular bags made of compound materials, such as aluminium compound bags, are particularly well-suited for this purpose. The tubular bags are opened by blades that rotate along when the dispensing tube is being screwed in. The bags are cut open in the course of the rotational motion of the blades and openings in the cartridges for dispensing the content are thus provided. The pasty bag content is subsequently squeezed through these openings in the cartridges in the direction of the static mixer.

In this context, it is disadvantageous that packaging pasty materials in tubular bags and, in addition, in cartridges is quite expensive and reserved for special applications only. Moreover, it is a problem in many applications, especially in the field of medicine, that parts of the cut tubular bags may become detached and thus may enter into the pasty components and thus contaminate the mixing ware.

Currently, pasty components from cartridge systems of adhesives and sealants are usually squeezed out through mechanical squeezing devices that are operated through hand motions of the user. This is disadvantageous in that the user needs to make a strong physical effort, in particular if large volumes are to be squeezed out. Besides, compressed air-operated applicator devices are customary, in particular in industrial applications of cartridge systems, in which pasty substances need to be applied continuously over a relatively short period of time. Said devices are connected to compressors through compressed air hoses or compressed air lines.

Another option is to squeeze out cartridges through compressed gases that are stored in gas cartridges that are situated in applicator devices. Said systems have generally been known for decades.

U.S. Pat. No. 2,818,899 proposes a sealant gun that contains a gas cartridge in its handle. Once the cartridge is opened, the compressed gas of the gas cartridge presses a plunger within the cartridge in the direction of the cartridge head. The flow of the pasty mass is controlled by a central rod that extends through the cartridge and can close the outlet opening of the cartridge.

U.S. Pat. No. 3,938,709 (1976) describes a dispensing device in which gas pressure is used to squeeze out a tube that is situated inside the hollow gun body. In this context, the gas flow is attained through a simple pin valve having a spring that can be actuated through a manual lever. A device for release of the gas was not provided. This means that the gun continues to squeeze the material due to the existing residual pressure although the gas feed is interrupted.

EP 0 169 533 A2 (1985) discloses an injection device for viscous substances. In this device, the squeezing process does not continue after the supply of compressed gas is interrupted, because an injection control valve that interrupts the flow of viscous substance is situated at the outlet opening. What is interesting in this context is that the valve of the trigger grip can be used to control both the supply of gas and the exit of the viscous substance. The injection control valve closes when there is no application of compressed gas.

A similar system is described in U.S. Pat. No. 4,925,061. However, in this system the injection control valve is actuated through a rod that is connected to the trigger grip.

A gun for squeezing out bone cement is disclosed in EP 1 118 313 A1. Propulsion is effected through a gas cartridge in this case also. What is essential is that this very complex system includes a rod that serves the purpose to expel the residual amount of cement contained in the dispensing tube. This elegant technical solution is very well-suited for conventional polymethylmethacrylate bone cements. However, said gun cannot be used for cartridge systems for mixing multiple components through a static mixer. Moreover, the manufacture of said gun is very elaborate.

US 2004/0074927 A1 describes an applicator gun which discloses essentially the same features as U.S. Pat. No. 4,925,061.

Printed publications US 2005/0230433 A1, US 2005/0247740 A1, and U.S. Pat. No. 6,935,541 B1 propose basically the same technical solution that is known already from EP 0 169 533 A2.

WO 2008/109439 A1 discloses a compressed gas-operated dispensing device that uses a hydraulic medium onto which the compressed gas exerts pressure.

It should be noted that the dispensing devices known to date, which are propelled by gas cartridges and have a complex mechanical structure, are suitable for manufacture as disposable articles only to a limited extent or not at all. Especially the valves proposed thus far are very expensive and thus make the use of the dispensing devices as disposable articles questionable. Moreover, the proposed technical solutions are difficult to implement in the form of plastic injection moulding parts.

Polymethylmethacrylate bone cements have been in use in medicine for decades for permanent mechanical fixation of total joint endoprostheses. They are based on powder-liquid systems. Recently, polymethylmethacrylate bone cements that are based on the use of cement pastes have been proposed as well (DE 10 2007 050 762 A1, DE 10 2008 030 312 A1, DE 10 2007 052 116 A1). Thus far, no suitable cartridge systems have been proposed for said cements.

With regard to the application of bone cements for fixation of total joint endoprostheses, it is always necessary to take into consideration that the OR staff is under time pressure during these surgeries. Therefore, as a matter of principle, cartridge systems for medical applications involving the application of paste-like polymethylmethacrylate bone cements should be designed such that they are largely resistant to user errors and can be operated rapidly and safely even in stressful situations.

The methylmethacrylate monomer is an essential ingredient of paste-like polymethylmethacrylate bone cements. Said monomer evaporates readily and has a relatively high vapour pressure at room temperature. For this reason, it is essential to note with regard to the use of methylmethacrylate-containing pastes that the cartridge plungers in the cartridges may be moved and may be expelled from the cartridges in the extreme case by the evaporating methylmethacrylate upon exposure to a vacuum, such as during the de-gassing as part of ethylene oxide sterilisation.

SUMMARY OF THE INVENTION

It is therefore the object of the invention to provide a cartridge system that is easy and inexpensive to manufacture, but at the same time allows the cartridges to be opened safely and easily. Moreover, safe storage and safe closure in case of pasty components should be provided in addition. The cartridge system should be safe and rapid to open right with minimal effort right before application of the pastes in order to render the application during surgeries easy and thus reduce and/or overcome the shortcomings of existing cartridge systems and their closure systems. Furthermore, operating errors of the user should be preventable.

These objects are met in that a rotatable valve is mounted in rotatable manner in a bracket on the cartridge head or cartridge heads or a shiftable valve is mounted in shiftable manner in a bracket on the cartridge or cartridges, whereby the valve comprises at least one passage through the valve that is connected to an outlet opening, the valve, in a closed position, closes in a sealed manner at least one opening of at least one cartridge, in particular all openings of all cartridges, the passage or passages is/are connected to the opening or openings in an open position of the valve such that a cartridge content can be squeezed from the cartridge or cartridges through the outlet opening, and whereby the valve can be transitioned from the closed position into the open position through a rotation of the valve or through shifting the valve, whereby the motion of the valve leads to a compressed gas cartridge that is or can be arranged in the cartridge system being opened through the compressed gas cartridge moving with respect to an opening device of the cartridge system.

In this context, the invention can provide the compressed gas cartridge to be connected in a fixed manner to the cartridge wall or cartridge walls and the opening device to be movable through the motion of the valve or the opening device to be connected in fixed manner to the cartridge wall or cartridge walls and the compressed gas cartridge to be movable through the motion of the valve.

The invention can also provide the compressed gas cartridge or the opening device to be connected in fixed manner to the valve that can be shifted in the longitudinal direction of the cartridge or cartridges.

Alternatively, the invention can provide the compressed gas cartridge or the opening device to be arranged in shiftable manner next to the cartridge or cartridges, in particular in an intervening space between the cartridges, and the rotatable valve to comprise an extension opposite from the outlet opening, which shifts the compressed gas cartridge or the opening device from the closed into the open state in the direction of the cartridge floor upon a rotation of the rotatable valve and thus opens the compressed gas cartridge through the opening device.

Cartridge systems according to the invention can also be characterised in that the opening device comprises a mandrel for opening a valve of the compressed gas cartridge.

In this context, the invention can provide the mandrel to comprise a passage through which the gas can be guided from the opened compressed gas cartridge, whereby the passage preferably has a throttle valve arranged in it.

Moreover, the cartridge system is proposed to be closed on the cartridge floor by a cover, in particular in gas-tight manner.

The invention further proposes the opening of the opened compressed gas cartridge in the open position of the valve to be arranged in a pressurised space that is arranged next to the cartridge or cartridges, in particular between the cartridges, and preferably is sealed from the surroundings in a gas-tight manner.

In this context, the pressurised space can be provided to be connected, through at least one connection, to a rear region of the cartridge or to the rear regions of the cartridges such that an increase in the pressure in the pressurised space leads to the feed plunger(s) moving in the direction of the cartridge head or cartridge heads when the outlet opening is open.

It is preferred for the cartridge system to comprise at least two, more preferably three, cartridges in parallel arrangement with respect to each other, for producing a mixing ware.

In this context, the feed plungers of the cartridges can be provided to be connected to each other through at least one fin and the cartridge walls to comprise slits that extend from the cartridge floor to approximately half of the length of the cartridges, whereby the side of the feed plungers facing the cartridge heads, even in its starting position, is arranged higher than the slits in the cartridges such that the front region of the cartridges for the cartridge content or containing the cartridge content is separated from the rear region of the cartridges, in particular in a gas-tight manner, and whereby the slits are sufficiently wide to facilitate a motion of the fin or fins through the slits.

The invention also proposes a dispensing tube commencing on the outlet opening and extending the passage to a dispensing tube tip to be arranged on the valve or connector, whereby the dispensing tube preferably comprises a static mixer on its inside.

In this context, the invention can provide a dispensing tube valve to be arranged in the dispensing tube that allows the volume flow of the material to be applied to be interrupted, in particular to be controlled.

Moreover, the invention proposes a cartridge system in which at least one sealing washer is arranged on one opening or multiple openings in the valve and/or the opening or openings between the cartridge wall or the cartridge head and the valve such that, in the open position of the valve, at least one fluid-tight connection from the at least one opening in the cartridge or cartridges to the passage(s) is provided.

And lastly, the invention proposes that the valve, which is shaped, in particular, to be cylindrical or like a portion of a cylinder, to be arranged, in the open and in the closed position, in press-fit manner above the openings on the cartridge head or cartridge heads or on the cartridge wall or cartridge walls and to close these in a sealed manner or to connect them to the passage or passages in a sealed manner.

The invention is therefore based on the surprising finding that it is feasible to combine a motion of the valve, through which the cartridge system is opened and thus a material is provided for application, and the opening of a compressed gas cartridge in order to simplify the operation of the cartridge system. In this context, the force that needs to be applied during the motion of the valve can be used to press a mandrel into a valve of the compressed gas cartridge that is provided for this purpose, and to thus open the compressed gas cartridge. In a cartridge system structured according to the invention, the gas pressure then leads to a propulsion of the feed plunger in a cartridge or of multiple feed plungers in multiple cartridges of the cartridge system through which a material stored therein can be expelled. In order to control the dispensation of material, throttle valves can be provided between the compressed gas cartridge and the feed plungers and on a dispensing opening/outlet opening of the cartridge system.

If the cartridge system comprises the compressed gas cartridge and a dispensing tube directly, the cartridge system can be used immediately and is made ready for use through a single motion, namely rotation of a rotatable valve or shifting of a shiftable valve. This can be a crucial advantage under difficult conditions of use, for example during the use as cartridge system for bone cements in OR applications.

The new development is a cartridge system that contains an integrated propulsion mechanism such that an additional device for squeezing out, such as a cartridge applicator gun for example, is no longer required. Moreover, the dispensing tube is transitioned to the dispensing position on the cartridge head or cartridge heads synchronous to the cartridges being opened in order to prevent operating errors of the user. Moreover, the cartridges are opened synchronous to the activation of the propulsion system. No particles can be released while a cartridge system according to the invention is being opened.

A cartridge system of this type can be made altogether of inexpensive injection moulding parts. A compressed gas cartridge, present as an option, and the spring, present as an option, are preferably made of metal. The cartridge system enables multiple feed plungers to be moved synchronously in the cartridges in the direction of the cartridge system head upon application of a force, and thus allows the flowable materials to be squeezed out evenly in order to ensure the proper mixing ratio of the pastes with respect to each other.

In the scope of the invention, the term, flowable material, is understood to mean liquid materials, viscous materials and even highly viscous materials that flow only upon the application of pressure.

A shiftable closure in the scope of the present invention is also understood to be a closure which is initially, in the starting position, connected through a fixed connection to the walls of the intervening space, for example through thin bridges, provided said fixed connection includes predetermined breakage sites, which break when a force acts on the closure and thus facilitate the shifting of the closure under the action of a force.

In this context, the invention proposes the fixed connection or fixed connections having the predetermined breakage sites to be provided in the direction, viewed from the openings of the cartridges, in which the closure moves during the opening process in order to prevent particles of the predetermined breakage sites from entering into the mixing ware and/or into the starting components of the mixing ware.

BRIEF DESCRIPTION OF THE DRAWINGS

In the following, exemplary embodiments of the invention are illustrated through two schematic drawings. In the figures.

DETAILED DESCRIPTION

Figure 1:
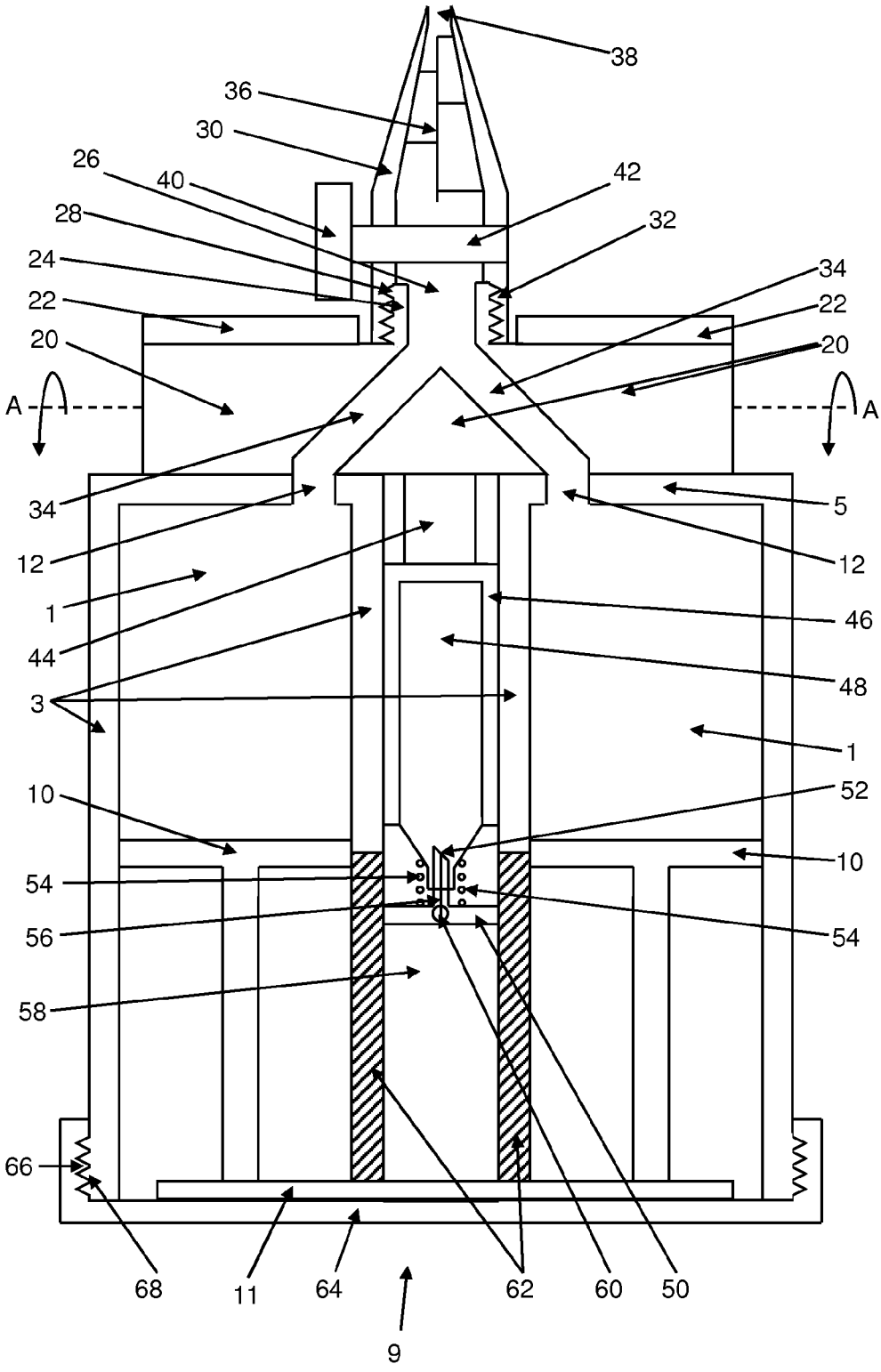
FIG. 1 shows a cross-sectional view in longitudinal direction of a cartridge system according to the invention with open closure.

FIG. 1 shows a schematic cross-sectional view of a cartridge system according to the invention that is suitable for mixing a mixing ware consisting of two or more components. For this purpose, the cartridge system comprises at least two cartridges (1) that contain the starting components of the mixing ware, which consist of flowable materials. Aside from the two cartridges (1) shown in FIG. 1, more cartridges can be provided and are arranged, for example, behind the two cartridges (1) shown. The cartridges (1) are bounded by cartridge walls (3) on the side and by cartridge heads (5) in the front. From the direction of the cartridge floor (9), the cartridges (1) are closed in a gas-tight manner through feed plungers (10) such that flowable cartridge contents can be squeezed from the cartridges (1) by applying compressed air to the feed plungers (10). The two cartridges (1) are connected to each other in a fixed manner through a fin (11). Openings (12) are provided in the cartridge heads (5).

Above the two openings (12), a valve (20) is arranged on the cartridge heads (5) and is mounted in a bracket (22), which is connected to the cartridge heads (5) in a fixed manner, such as to be rotatable about rotation axis (A). A cylindrical connector (24) that is provided as a hollow body and comprises an outlet opening (26) and an external thread (28) is arranged on one side of the valve (20). The bracket (22) includes a cut-out in this region. For this purpose, the bracket (22) can be made up by two parts. The external thread (28) is suitable for fastening a dispensing tube (30) having a matching internal thread (32). However, the dispensing tube (30) can just as well be connected to a valve (20) in a fixed manner, i.e. have no internal thread (32) and external thread (28). The openings (12), and therefore the cartridge system, can be closed through rotation of the valve (20) about the rotation axis (A). The cartridge system is then closed and the valve (20) is situated in the closed position.

On the inside of the valve (20) are situated two passages (34), which, in the open position of the valve (20) shown in FIG. 1, form a continuous connection from said two openings (12) of the cartridges (1) to the outlet opening (26). Applying a pressure to the feed plungers (10), the flowable material (not shown) contained in the cartridges (1) is squeezed from the cartridges through the openings (12) and the passages (34) into the connector (24). A dispensing tube (30) is attached on the outlet opening (26) and contains a static mixer (36) such that the two starting components are mixed more thoroughly in the dispensing tube (30). The mixing ware can then be applied through a dispensing tube tip (38) of the dispensing tube (30). A stopcock (40), through which a dispensing tube valve (42) can be operated, is arranged on the dispensing tube (30). The dispensing tube valve (42) can close the dispensing tube (30) again and can also be opened again through the stopcock (40). The dispensing tube valve (42) preferably is a throttle valve that can be used to regulate the flow of mixing ware from outside. Accordingly, the dispensing tube valve (42) can not only be open or closed, but it can also control the cross-section of the passage through the outlet tube (30).

An extension (44) having a rounded shape is arranged on the side of the rotatable valve (20) that is opposite to the connector (24). Rotating the rotatable valve (20) into the open position, the extension (44) presses onto a plunger (46) that can be moved between the cartridges (1) in the direction of the cartridge axes and in which a compressed gas cartridge (48) can be inserted. Accordingly, upon rotation of the valve (20), a compressed gas cartridge (48) that is arranged in the mobile plunger (46) is pressed in the direction of the cartridge floor (9) through the extension (44). In the region between the cartridges (1), a fin (50) is arranged between the cartridge floor (9) and the mobile plunger (46). A hollow mandrel (52) whose tip points towards the mobile plunger (46) is arranged on the fin (50). A spring (54) is arranged about the hollow mandrel (52) up to the compressed gas cartridge (48). While opening the rotatable valve (20), the extension (44) presses onto the mobile plunger (46) with the compressed gas cartridge (48), which is being positioned by the spring (54), and thus pushes the compressed gas cartridge (48) onto the hollow mandrel (52), whereby the spring (54) is compressed in the process. In the process, the compressed gas cartridge is opened and the gas can escape.

A passage (56), through which the gas can escape from the compressed gas cartridge (48), is situated on the inside of the hollow mandrel (52). The passage also extends through the fin (50) on which the mandrel (52) is arranged. The cartridge walls (3) pointing in the direction of the mobile plunger (46) also bound, laterally, a pressurised space (58) that is closed to the outside and has the passage (56), and thus the opened compressed gas cartridge (48), exit in it. In order to control the exit of gas from the compressed gas cartridge (48), a throttle valve (60) is arranged in the passage (56) and can be used to control the flow of gas through the passage (56) and/or out of the compressed gas cartridge (48), and thus control the pressure in the pressureised chamber (58). For this purpose, a stopcock, a lever or a screw head (not shown) is arranged on the throttle valve (60) through which the throttle valve (60) can be controlled from outside.

The cartridge walls (3) are slitted in that region of the cartridges (1) facing the cartridge floor (9) and this is provided in a manner such that the feed plungers (10) separate a front region of the cartridges (1), extending from the feed plungers (10) to the cartridge heads (5), from a slitted rear region of the cartridges (1) in a gas-tight manner. Seals (not shown) are provided on the feed plungers (10) for this purpose and terminate in a sealed manner against the non-slitted cartridge walls (3) and prevent gas from flowing from the rear region to the front region. The slitted part of the cartridge walls (3) is shown hatched in FIG. 1. The slit (62) also extends through the walls of the pressurised space (58) and thus connects the pressurised space (58) to the rear region of the cartridges (1). However, the slit (62) has no connection to the outside. The slit (62) is sufficiently wide to take up a fin (50) and facilitate a motion of the fin (50) along the slit (62).

In the direction of the cartridge floor (9), the cartridge system is closed with respect to the outside though a cover (64) in gas-tight manner. For this purpose, the cover (64) comprises a fastening means (66) in the form of a snap-in device that engages a fastening means (68) in the form of an opposite snap-in device on the cartridge floor (9) on the cartridge walls (3) and the walls of the pressurised space (58) and thus separates the pressurised space (58) and the rear region of the cartridges (1) from the surroundings. If the cartridge system has a suitable, rounded structure on the cartridge floor (9), an internal thread (66) and an external thread (68) can be provided as alternative fastening means (66, 68). The cover (64) can just as well be flat, and simply be flange-mounted. A seal (not shown) can be provided in the region of the cover (64) in order to seal the connection of the cover (64) with respect to the rear regions of the cartridges (1) and the pressurised space (58). The invention also provides the cover (64) to be connected in a fixed manner to the cartridge walls (3) and the walls of the pressurised space (58), in particular in a gas-tight manner.

In the starting state (not shown in FIG. 1), the dispensing tube (30) is situated lying in the region between the cartridges (1), projecting at a right angle or in any position in between, and the openings (12) are closed through the rotatable valve (20), since the passages (34) of the rotatable valve (20) are not connected to the openings (12) in this position. A user of the cartridge system simply needs to screw-in the dispensing tube (30) into the working position by rotating the valve (20) about rotation axis (A) such that the dispensing tube (30) extends the symmetry axes of the cartridges (1). Rotating the valve (20) opens the cartridges (1), since the openings (12) are now connected through the passages (34) to the dispensing tube (30). Simultaneously, the extension (44) pushes the plunger (46) having the compressed gas cartridge (48) onto the hollow mandrel (52) such that the compressed gas cartridge (48) is opened. The gas flows from the compressed gas cartridge (48) and thus builds up a pressure in the pressurised space (58). Since the pressurised space (58) is connected to the rear regions of the cartridges (1) through the slits (62), but simultaneously is closed in a sealed manner with respect to the outside, the gas presses on the sides of the feed plungers (10) facing the cartridge floor (9). The pressure propels the feed plungers (10) in the cartridges (1) in the direction of the cartridge head (5). Simultaneously, the fin (11) connecting the feed plungers (10) to each other is pushed forward by the cartridges (1), the slit (62), and the pressurised space (58).

The front region of the cartridges (1) is filled with a cartridge content (not shown) that is squeezed through the openings (12), is mixed in the outlet opening (26) and the static mixer (36) of the dispensing tube (30), and finally is expelled out of the dispensing tube tip (38) due to the motion of the feed plungers (10). The fin (11) simply ensures that the feed plungers move in the direction of the cartridge heads (5) at equal speed even if the motion of the various feed plungers (10) in the cartridges (1) encounters different resistances because the cartridge contents differ. If no difference in the resistances to the motion of the feed plungers (10) is to be expected, the fin (11) is dispensable such that the isostatic pressure from the compressed gas cartridge (48) moves both feed plungers (10) evenly in this case. The slits (62) can also be replaced by smaller openings that connect the pressurised space (58) to the rear region of the cartridges (1). The cross-section of said openings should be larger than the cross-section of the passage (56), or the open cross-section of the completely closed throttle valve (60) for the pressure to spread without difficulty through the openings from the pressurised space (58) to the rear regions of the cartridges (1).

The throttle valve (60) and/or dispensing tube valve (42) can be used to control the flow of mixing ware to be applied that exits from the dispensing tube tip (38). The throttle valve (60) controls the cross-section of the passage (56) and thus the pressure that is applied to the rear sides of the feed plungers (10). This renders the propelling force acting on the feed plungers (10) controllable. The dispensing tube valve (42) determines the internal cross-section of the dispensing tube (30) and thus controls the resistance encountered by the flow of the mixing ware through the dispensing tube (30).

The cartridge system shown in FIG. 1 having two cartridges (1) can be simplified without any difficulty to a cartridge system having one cartridge (1), or generalised to a cartridge system having three, four, five or even more cartridges (1). Accordingly, one or more further cartridges could be arranged behind the cartridges (1) shown in FIG. 1, whose feed plungers also are connected to each other through the fin (50) or through additional fins through slits in the cartridge walls. The rotatable valve (20) then comprises for each cartridge a passage (34) that connects openings on the cartridge heads to the outlet opening (26, and/or to the dispensing tube (30). Each cartridge is connected to the pressurised space (58) in its rear region.

Selection of different cartridge diameters allows mixing ratios of the cartridge contents that differ from equal ratios to be generated.

Figure 2:
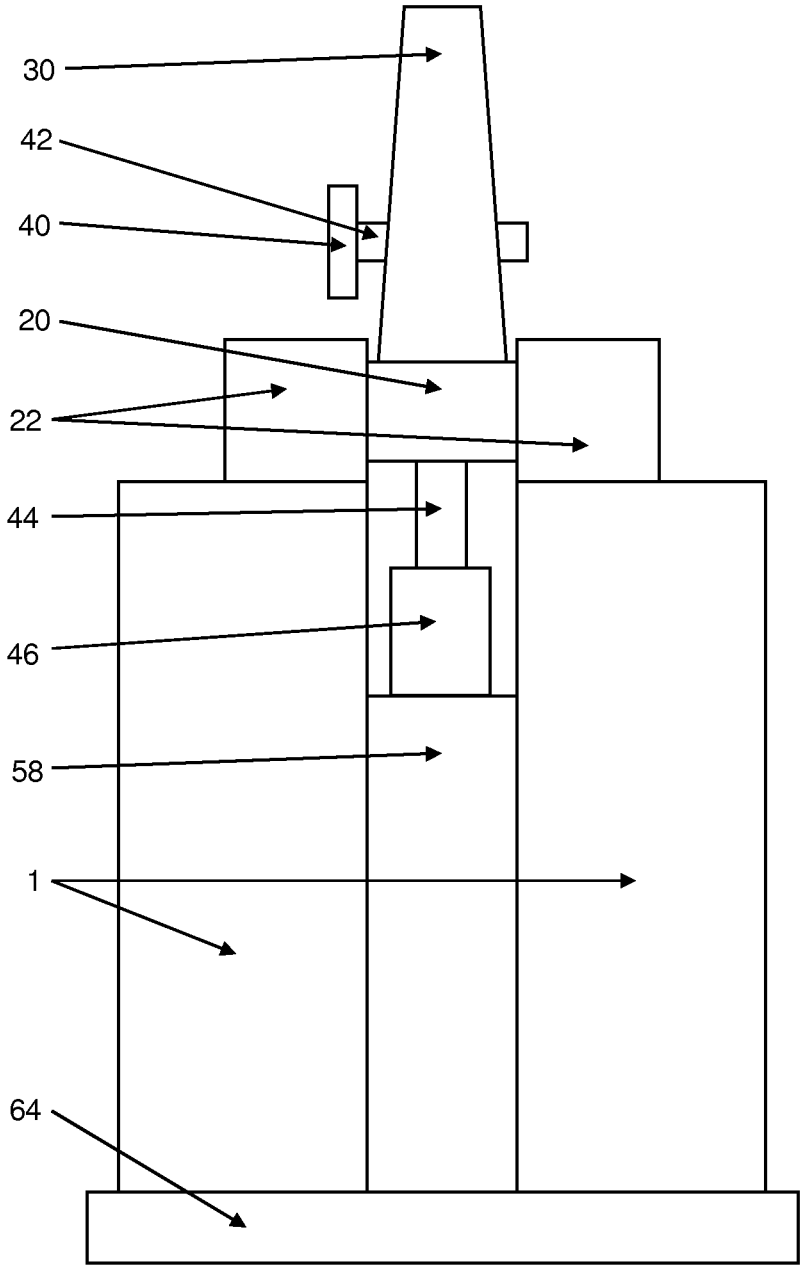
FIG. 2 shows a side view of the cartridge system according to the invention according to FIG. 1.

FIG. 2 shows a side view of the cartridge system according to the invention according to FIG. 1; Two cartridges (1) arranged parallel with respect to each other can be seen from outside. The pressurised space (58), which is closed with respect to the outside, is arranged between the two cartridges (1). A plunger (46), which is mobile along the pressurised space (58) and in which a compressed gas cartridge is arranged, projects from the pressurised space (58). Bearings (22) for a rotatable valve (20) are arranged on the cartridge heads.

A dispensing tube (30) is arranged on the front of the rotatable valve (20) and comprises a dispensing tube valve (42) having a stopcock (40). An extension (44), which pushes the mobile plunger (46) into the pressurised space (58) in the application position shown, is arranged on the rear of the rotatable valve (20). The cartridge system is closed on the floor side through a cover (64).

The extension (44) is rotated downward along with the rotation of the dispensing tube (30) in the direction of the cartridge head (5) or cartridge heads (5). In the process, it presses onto the mobile plunger (46) while the rotational motion of the cylindrical valve (20) is progressing. Accordingly, the mobile plunger (46) presses the gas cartridge (48) downward in the direction of the hollow mandrel (52) against the spring (54). The spring force of the spring (54) must be overcome in addition to friction. The gas cartridge (48) moves towards the hollow mandrel (52) and is penetrated by it. This allows the compressed gas to exit. The lid (64) prevents uncontrolled gas exit from the closed cartridge system, and the gas presses onto the feed plungers (10). This causes the flowable materials in the cartridges (1) to be pressed in the direction of the cartridge heads (5).

The dispensing tube (30) is connected in the cartridges (1) through the rotatable valve (20) that is situated in at least two yoke-shaped bearings (22). The system according to the invention works such that the dispensing tube (30) is rotated in the direction of the cartridge floor (9) in the closed state. The dispensing tube (30) preferably is situated to be lying parallel to the cartridges (1). For the opening process, the dispensing tube (30), which is folded downwards in the direction of the cartridge floor (9), is simply rotated upwards in the direction of the cartridge head (5) or cartridge heads (5). When the dispensing tube (30) is rotated downwards in the direction of the cartridge floor (9), the openings are not situated to coincide with the openings (12) of the cartridge head (5) or cartridge heads (5). Rotating the dispensing tube (30) upwards causes the rotatable valve (20) to be rotated in a manner such that the openings of the valve (20) coincide with the openings (12).

This means that the user simply needs to fold the dispensing tube (30) upwards in the direction of the cartridge head (5) into the application position or screw it into the cartridge system to open the cartridges (1). The user does not need to connect the dispensing tube (30) to the cartridges (1).

According to the invention, the valve (20) that is provided as a rotatable cylinder is closed on both narrow sides and preferably tapers conically from one narrow side to the other. This allows the rotatable valve (20) to be mounted in the bearings (22) without any difficulty.

Moreover, according to the invention, the valve (20) preferably is situated in a press-fit manner in the yoke-shaped bearings (22) or on the cartridge wall (103). A sufficient sealing effect is attained through the press-fit. Furthermore, according to the invention, additional sealing rings can be arranged on the valve (20) provided this is necessitated by the properties of the flowable materials to be stored in the cartridges (1).

Moreover, according to the invention, the external diameter of the dispensing tube (30) right above the connecting site of the rotatable valve (20) and the dispensing tube (30) preferably is equal to or smaller than the distance between the yoke-shaped bearings (22). The dispensing tube (30) fixes the valve (20) in place between the bearings (22). This prevents the valve (20) from slipping out.

What is important for a multi-component cartridge system according to the invention to be leakproof is that a first bearing (22) has a larger internal diameter than a second bearing (22), and that the connection site from the rotatable valve (20) to the dispensing tube (30) is at a distance to the first bearing (22) that is smaller than half of the external diameter of the dispensing tube (30) right above the connecting site of the rotatable valve (20) and the dispensing tube (30). This simplifies the mounting of the rotatable valve (20). If half of the external diameter of the dispensing tube (30) is slightly larger than the distance of the middle of the connecting site of the rotatable valve (20) and the dispensing tube (30), the dispensing tube (30) presses the rotatable valve (20) into the bearings (22). This prevents the rotatable valve (20) from slipping out and strongly presses the valve (20) into the bearings (22) such that a good sealing effect is achieved.

Moreover, according to the invention, the openings of the rotatable valve (20) and the openings (12) of the cartridge head (5) or cartridge heads (5) form at least one connection between the internal spaces of the cartridges (1) that is permeable for flowable materials, when the axis of the dispensing tube (30) is situated to be parallel to the longitudinal axis of the cartridge (1) or the longitudinal axes of the cartridges (1) and the opening (38) of the dispensing tube (30) is situated in the direction opposite to the cartridge head (5) or cartridge heads (5).

Moreover, according to the invention, the openings of the rotatable valve (20) and the openings (12) of the cartridge head (5) or cartridge heads (5) form at least one connection between the internal spaces of the cartridges (1) that is permeable for flowable materials, when the axis of the dispensing tube (30) is situated to be parallel to the longitudinal axis of the cartridge (1) or the longitudinal axes of the cartridges (1) and the opening (38) of the dispensing tube (30) is situated in the direction opposite to the cartridge head (9) or cartridge heads (9).

For opening the gas cartridge (48), it is advantageous that the extension (44) preferably is provided to be semi-circular in shape. The extension (44) being semicircular in shape allows the extension (44) to easily press, about its axis, onto the mobile plunger (46) upon a rotational motion of the valve (20) and thus open the gas cartridge (48).

Figure 3:
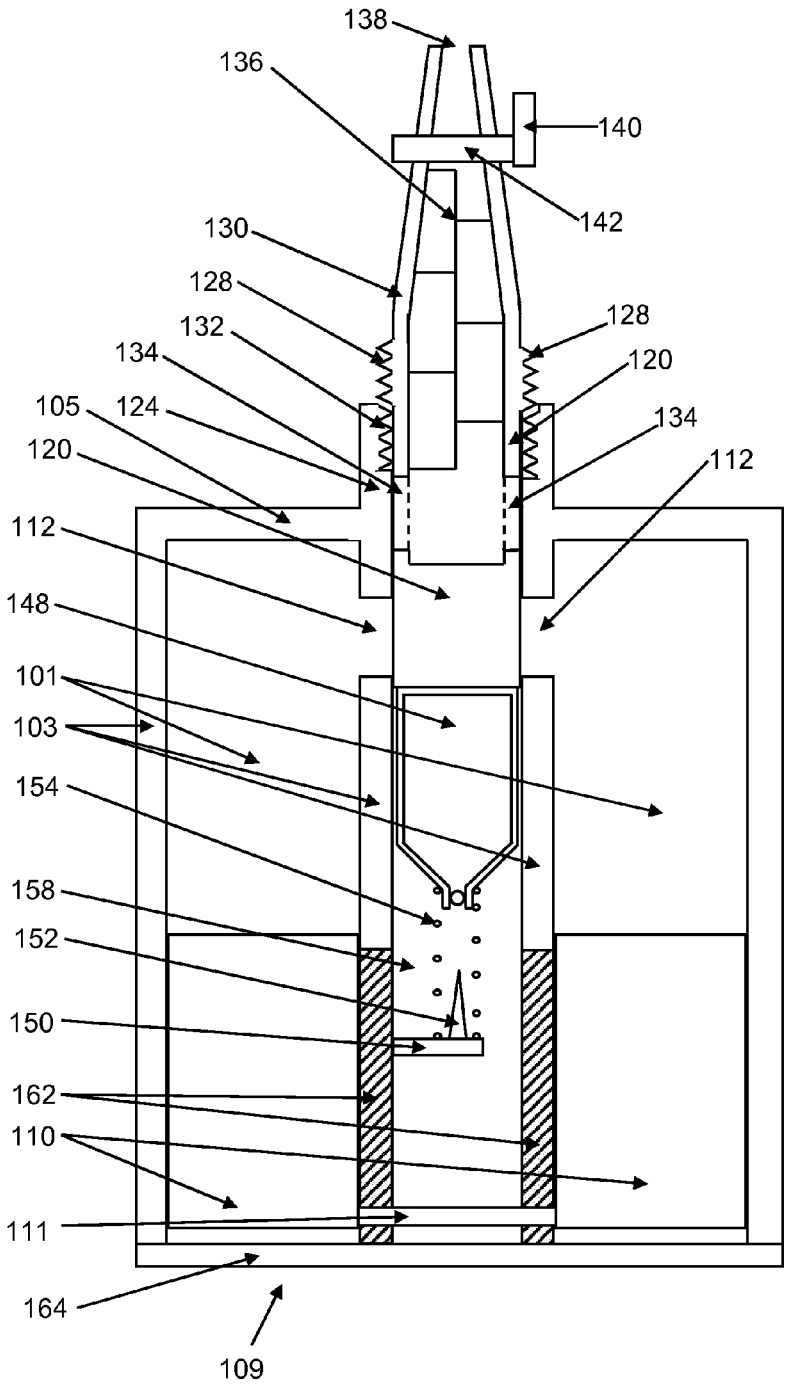
FIG. 3 shows a cross-sectional view in longitudinal direction of a second cartridge system according to the invention.

FIG. 3 shows a schematic longitudinal section of an alternative cartridge system with inserted dispensing tube (130). In this exemplary embodiment, a valve (120), which is positioned between two cartridges (101) and can be shifted in longitudinal direction of the intervening space between cartridges, and the dispensing tube (130) are provided as a unit. The two parts are connected to each other in a fixed manner. The dispensing tube (130) further comprises a dispensing tube tip (138), a fastening means (128), a static mixer (136), and a dispensing tube valve (142) that can be operated through a stopcock (140). Passages (134) are provided in the valve walls.

In its starting position shown in FIG. 3, the valve (120) is placed in a press-fit manner in an intervening space that is closed by a cylinder wall and is situated between the two cartridges (101) which are closed on their floor side through feed plungers (110). In said position, the valve (120) closes two openings (112) that connect the interior spaces of the cartridges (101) to the closed intervening space. The openings (112) are situated in the cartridge walls (103) facing the intervening space. A connector (124) that extends the closed intervening space comprises, on the inside, a fastening means (132) that can act in concert with the fastening means (128) of the dispensing tube (130). The fastening means (128, 132) can, for example, be internal and external threads. The two threads can already be partially engaged to each other in the starting position of the valve (120). Upon the system of valve (120) and dispensing tube (130) being screwed-in or fastened, the valve (120) is shifted such that the openings (112) are freed, whereby, in the final position, the openings (112) are situated over the passages (134).

A closed pressurised space (158) is situated below the closed intervening space and the valve (120). The closed intervening space and the pressurised space (158) are basically bounded by the same cylinder walls and separated from each other by the floor of the valve (120). With the dispensing tube (130) having the shiftable valve (120) removed from the cartridge system, the closed intervening space and the pressurised space (158) form a cylindrical hollow space that is open in the direction of the cartridge heads (105). The two feed plungers (110) are connected in a fixed manner to each other through a fin (111). The cartridge walls (103) and the cylinder wall of the pressurised space are slitted in the direction of the cartridge floor (109) such that the fin (111) can easily move through the slit (162).

In the direction of the cartridge floor (109), the cartridge system is closed in a sealed manner through a cover (164). A fin (150) having a mandrel (152) that is oriented in the direction of the shiftable valve (120) projects from one cartridge wall (103). Said fin (150) and the fin (111) for connecting the feed plungers (110) to the slits (162) are arranged on the cartridge wall (103) in a manner such that the fin (150) having the mandrel (152) does not impede a motion of the fin (111) in the slits (162) for connecting the feed plungers (110). For this purpose, the fin (111) for connecting the feed plungers (110) and the slits (162) are preferably not arranged in the middle of the pressurised space (158). Still, the pressurised space (158) must be sealed with respect to the outside, i.e. the slits (162) must not be connected to the outside. Alternatively, the fin (150) is shifted in the direction of the connector (124) to the extent that the fin (111) meets the fin (150) only when the feed plungers (110) have arrived at the cartridge heads (105).

A compressed gas cartridge (148) is arranged in the pressurised space (158) on the floor of the shiftable valve (120). The compressed gas cartridge (148) is fixed in place through a spring (154) between the fin (150) and the compressed gas cartridge (148). However, the compressed gas cartridge can just as well be connected on the floor of the shiftable valve (120) in detachable manner through a fixation device (not shown). In said case, the spring (154) is dispensable. Prior to inserting the system of valve (120) and dispensing tube (130) in the cartridge system, a compressed gas cartridge (148) can then be fixed in place on the floor of the shiftable valve (120). Bayonet closures and snap-in locking devices with pegs, for example, are conceivable fixation devices. However, the valve (120) can just as well comprise a hollow space to take up the compressed gas cartridge (148), in which the compressed gas cartridge (148) is inserted and which is subsequently closed through a lid, which then forms a part of the valve (120), for example by screwing it shut. For this purpose, the lid needs to comprise an opening through which the compressed gas cartridge (148) can be opened and from which the head of the compressed gas cartridge (148) projects. Likewise, the compressed gas cartridge (148) having the valve (120) and the dispensing tube (130) can form a fixed structural component.

Upon the dispensing tube (130) being screwed by its external thread (128) into the internal thread (132) of the connector (124), the shiftable valve (120) having the compressed gas cartridge (148) is slid into the pressurised space (158). For this purpose, the openings (112) in the cartridge walls (103) are opened and connected to each other through passages (134) in the valve (120). Simultaneously, the compressed gas cartridge (148) is moved onto the mandrel (152) and thus opened. The pressure from the compressed gas cartridge (148) is then applied in the pressurised space (158) and propagates through the slits (162) in the floor-side region of the cartridges (101). The pressure shifts the feed plungers (110) in the cartridges (101), whereby the content of the cartridges (101) is expelled through the openings (112), the passages (134), the hollow space in the valve (120), the static mixer (136) of the dispensing tube (130), and lastly out of the dispensing tube tip (138). The feed plungers (110) can be designed to have a suitable shape to take up the pressure in improved fashion. A seal (not shown) is arranged on the feed plungers (110) and separates the cartridge content from the pressurised space (158), preferably in a gas-tight manner. Accordingly, the pressure from the pressurised space (158) must not be propagated between the feed plungers (110) and the cartridge walls (103) to reach the front region of the cartridges (101).

Accordingly, the invention also relates to a multi-component cartridge system having a gas cartridge (48, 148), in which the opening (12, 112) of the cartridges (1, 101) is forced to occur synchronous to the opening of the gas cartridge (48, 148).

Accordingly, the scope of the invention also includes a multi-component cartridge system, that is characterised a) in that two or more cartridges (1, 101) are arranged about an internal hollow cylinder (58, 158) or an internal irregular- or regular-shaped hollow body (58, 158) and have longitudinal axes that are parallel to the axis of the internal hollow cylinder (58, 158) or the irregular- or regular-shaped hollow body (58, 158);

b) in that one or more openings (12, 112) are arranged in the cartridge heads (5, 105) and/or the cartridge walls (3, 103);

c) in that a dispensing tube (30, 130) is arranged;

d) in that the dispensing tube (30, 130) is connected on one end to a rotatable cylinder (20) or a shiftable cylinder (120);

e) in that the rotatable or shiftable cylinder (20, 120) possesses at least two openings that are connected to each other, whereby at least one opening is continuously connected to the dispensing tube (30, 130);

f) in that the rotatable cylinder (20) is mounted in at least two yoke-shaped bearings (22) that are connected to the cartridge head (5) or cartridge heads (5);

g) in that at least one opening (12, 112) is present in the cartridge head (5, 105) or cartridge heads (5, 105) and/or the cartridge wall (3, 103) or cartridge walls (3, 103) and is or are connected to the internal space of the cartridge (1, 101) or internal spaces of the cartridges (1, 101) in a continuous manner;

h) in that the dispensing tube (30, 130) connected to the rotatable cylinder (20) is arranged between the yoke-shaped bearings (22) or the dispensing tube (30, 130) connected to the shiftable cylinder (120) extends passages (34, 134) in the shiftable cylinder (120);

i) in that the rotatable cylinder (20) is arranged such as to be rotatable by at least 80° about its cylinder axis;

j) in that the rotatable cylinder (20) has, perpendicular to the rotation axis, an extension (44) on the side that is opposite to the connecting site of the dispensing tube (30, 130);

k) in that a mobile plunger (46) is arranged in the internal hollow cylinder (58, 158) or the internal irregular- or regular-shaped hollow body (58, 158) in a manner such that the plunger (46) projects in the direction of the cartridge head (5, 105) from the internal hollow cylinder (58, 158) or the internal irregular- or regular-shaped hollow body (58, 158);

l) in that a gas cartridge (48, 148) is arranged below the mobile plunger (46) in the internal hollow cylinder (58, 158) or the internal irregular- or regular-shaped hollow body (58, 158), whereby the opening of the gas cartridge (48, 148) is directed in the direction of the cartridge floor (9, 109);

m) in that a fin (50, 150), on which a hollow mandrel (52, 152) pointing in the direction of the opening of the gas cartridge (48, 148) is situated, is arranged in the internal hollow cylinder (58, 158) or the internal irregular- or regular-shaped hollow body (58, 158);

n) in that a spring (54, 154) is situated about the hollow mandrel (52, 152) and is mounted on the fin (50, 150) and touches the gas cartridge (48, 148) above the hollow mandrel (52, 152) in a manner such that the opening of the gas cartridge (48, 148) does not contact the hollow mandrel (52, 152);

o) in that the cartridges (1, 101) are closed through feed plungers (10, 110);

p) in that the feed plungers (10, 110) are connected to each other through fins (50, 150) on the side facing away from the cartridge floor (9, 109);

q) in that the internal hollow cylinder (58, 158) and the cartridges (1, 101) are connected through at least one slit (62, 162) originating from the cartridge floor (9, 109) and extending to half of their length, whereby the cross-section of the slit (62, 162) is smaller than the cross-section of the fins (50, 150);

r) in that the cartridge floors (9, 109) are connected to each other through a disc that is closed through a lid (64, 164) that is connected to the disc through a thread or a snap-in closure.

This excludes any mounting error during the application by design. During the use of the multi-component cartridge system, all cartridges (1, 101) are opened synchronously through the rotation of the dispensing tube (30) and thus of the valve (20) that is shaped as a rotatable cylinder, or through screwing-in or inserting the dispensing tube (130) and thus through sliding-in the shiftable valve (120). It is also advantageous for the dispensing tube (30, 130) to be connected to the multi-component cartridge system. The dispensing tube (30, 130) can thus not be lost before the application while unpacking the packaging means. Moreover, no separate packaging means are needed for the dispensing tube (30, 130) any longer.

An essential advantage of the cartridge system according to the invention is that the compressed gas as the propulsion system can already be present in the cartridge system and that the gas cartridge (48, 148) is also opened synchronous to the cartridges (1, 101) being opened. This simplifies the operation of the cartridge system maximally.

The cartridge system according to the invention provides the user with a device that can be operated rapidly, easily, and safely.

As an advantageous development, snap-in locking devices that are common in the plastics industry, for example in the form of pegs that are mobile in one direction, can be arranged on the bearings (22) or the dispensing tube (130) and fix the dispensing tube (30, 130) in the application position and prevent the dispensing tube (30, 130) from rotating in reverse direction from the application position. Another advantageous development has snap-in locking devices that are common in the plastics industry attached on the underside of the valve (20, 120) and prevent the dispensing tube (30, 130) from rotating in reverse direction or shifting backwards from the application position.

Moreover, according to the invention, a static mixer (36, 136) is arranged inside the dispensing tube (30, 130). The invention can also provide a valve device (42) to be arranged on the dispensing tube (30, 130) above the connecting site to the valve (20, 120). Said valve device (42) can be used to regulate the dispensing speed of the flowable material.

The scope of the invention includes a hand grip being arranged on the cartridges (1, 101) and preferably being of a fold-out type. Said hand grip allows the cartridge system to be held and guided easily by the user.

The scope of the invention also includes a method for opening the cartridge system and for activating the propulsion device, characterised in that the dispensing tube (30, 130) that is situated opposite from the direction to the cartridge head (5, 105) or cartridge heads (5, 105) and arranged on a rotatable valve (20) is rotated, by its dispensing opening (26, 38, 138), in the direction of the cartridge head (5, 105) until the dispensing tube (30, 130) stands perpendicular or approximately perpendicular to the axis or axes of the cartridge (1, 101) or cartridges (1, 101) and the dispensing opening (26, 38, 138) is oriented opposite to the cartridge head (5, 105) or cartridge heads (5, 105), or the dispensing tube (30, 130) is inserted or screwed into a connector (24, 124) on a shiftable valve (120), whereby the openings of the valve (20, 120) connect to openings (12, 112) of the cartridge head (5, 105) or cartridge heads (5, 105) or, as it may be, of the cartridge wall (3, 103) or cartridge walls (3, 103) and thus form at least one connection that is patent for flowable materials, and in that upon the dispensing tube (30, 130) being rotated or inserted, an extension (44) that is arranged on the rear of the rotatable cylinder (20, 120) rotates downwards in the direction of the cartridge floor (9, 109) and presses onto a mobile plunger (46), and in that said mobile plunger presses the gas cartridge (48, 148) against a spring (54, 154) until a hollow mandrel (52, 152) penetrates into an opening of the gas cartridge (48, 148) and the compressed gas is released, or the gas cartridge (48, 148) is arranged directly on the valve (20, 120) and the gas cartridge (48, 148) is therefore pressed against the spring (54, 154) until a hollow mandrel (52, 152) penetrates into an opening of the gas cartridge (48, 148) and the compressed gas is released.

Moreover, the scope of the invention includes a method for squeezing out the multi-component cartridge system, in which the compressed gas of the gas cartridge (48, 148) presses the feed plungers (10, 110) in the direction of the cartridge heads (5, 105) and the dispensing speed of the flowable material is controlled through actuation of the valve device (42, 142).

The cartridge system according to the invention is used for packing, storing, and applying paste-shaped bone cements, dental multi-component preparations, adhesives, sealants, cosmetics, and food items. The multi-component cartridge system is particularly well-suited for storing and applying paste-shaped polymethylmethacrylate bone cements.

The features of the invention disclosed in the preceding description and in the claims, figures, and exemplary embodiments, can be essential for the implementation of the various embodiments of the invention both alone and in any combination.

LIST OF REFERENCE NUMBERS

1, 101 Cartridge
3, 103 Cartridge wall
5, 105 Cartridge head
9, 109 Cartridge floor
10, 110 Feed plunger
11, 111 Fin
12, 112 Opening
20, 120 Valve/cylinder
22 Bracket/bearing
24, 124 Connector
26 Outlet opening
28, 128 Fastening means/external thread
30, 130 Dispensing tube
32, 132 Fastening means/internal thread
34, 134 Passage
36, 136 Static mixer
38, 138 Dispensing tube tip
40, 140 Stopcock
42, 142 Dispensing tube valve
44 Extension
46 Plunger
48, 148 Compressed gas cartridge
50, 150 Fin
52, 152 Mandrel
54, 154 Spring
56 Passage
58, 158 Pressurised space
60 Throttle valve
62, 162 Slit
64, 164 Cover
66 Fastening means/internal thread
68 Fastening means/external thread
A Rotation axis

What is claimed:

1. A cartridge system for application of a flowable material, the cartridge system comprising at least two cartridges, wherein each cartridge comprises cartridge walls, a cartridge head, and a feed plunger opposite the cartridge head for expelling a cartridge content, wherein each cartridge further comprises at least one opening in the cartridge head or the cartridge walls that is closable through a valve, wherein the valve is a rotatable valve mounted in a rotatable manner in a bracket on the cartridge heads of the at least two cartridges or a shiftable valve mounted in a shiftable manner in a bracket on the at least two cartridges, wherein the valve comprises at least one passage through the valve that is connected to an outlet opening, the valve, when located in a closed position, is configured to close in a sealed manner the at least one opening of the at least two cartridges, wherein the at least one passage is connectable to the at least one opening of the at least two cartridges when the valve is located in an open position such that a cartridge content is squeezable from the at least two cartridges through the outlet opening, and wherein the valve is movable from a closed position into an open position through a rotation of the valve or through shifting the valve, wherein motion of the valve leads to a compressed gas cartridge arranged in the cartridge system to be opened when the compressed gas cartridge is movable inwardly with respect to an opening device of the cartridge system, and further wherein an intervening space is provided between the at least two cartridges and the compressed gas cartridge and opening device are located within the intervening space between the at least two cartridges.

2. The cartridge system according to claim 1, wherein the opening device is connected in a fixed manner to the cartridge walls and the compressed gas cartridge is movable through the motion of the valve.

3. The cartridge system according to claim 1, wherein the compressed gas cartridge or the opening device is connected in a fixed manner to the valve that is movable in a longitudinal direction of the cartridge system.

4. The cartridge system according to claim 1, wherein the valve comprises an extension located opposite from the outlet opening, which moves the compressed gas cartridge or the opening device from the closed into the open state in a direction of the cartridge floor upon a movement of the valve such that the compressed gas cartridge is openable via the opening device.

5. The cartridge system according to claim 1, wherein the opening device comprises a mandrel for opening a valve of the compressed gas cartridge.

6. The cartridge system according to claim 5, wherein the mandrel comprises a passage through which the gas can be guided from the opened compressed gas cartridge, wherein the passage has a throttle valve arranged in it.

7. The cartridge system according to claim 1, wherein the cartridge system is closed on the cartridge floor by a cover.

8. The cartridge system according to claim 1, wherein an opening of the opened compressed gas cartridge in the open position of the valve is arranged in a pressurised space that is arranged next to the cartridges.

9. The cartridge system according to claim 8, wherein the pressurised space is provided to be connected, through at least one connection, to rear regions of the at least two cartridges such that an increase in pressure in the pressurised space moves the feed plungers in a direction of the cartridge heads when the outlet opening is open.

10. The cartridge system according to claim 1, wherein the cartridge system comprises the at least two cartridges are in parallel arrangement with respect to each other.

11. The cartridge system according to claim 10, wherein the feed plungers of the at least two cartridges are connected to each other through at least one fin and the cartridge walls comprise slits that extend from the cartridge floor to approximately half of the length of the cartridges, wherein a side of the feed plungers facing the cartridge heads, even in its starting position, is arranged higher than the slits in the cartridges such that a front region of the cartridges for the cartridge content or containing the cartridge content is separated from the rear region of the cartridges, and wherein the slits are sufficiently wide to facilitate a motion of the fin or fins through the slits.

12. The cartridge system according to claim 1, wherein a dispensing tube commencing on the outlet opening and extending the passage to a dispensing tube tip is arranged on the valve or connector, whereby the dispensing tube comprises a static mixer on its inside.

13. The cartridge system according to claim 12, wherein a dispensing tube valve is arranged in the dispensing tube and configured to allow the volume flow of the material to be applied to be interrupted.

14. The cartridge system according to claim 1, wherein at least one sealing washer is arranged on one opening or multiple openings in the valve and/or the openings between the cartridge wall or the cartridge head and the valve such that, in the open position of the valve, at least one fluid-tight connection from the at least one opening in the cartridges to the passage is provided.

15. The cartridge system according to claim 1, wherein the valve, which is shaped, in particular, to be cylindrical or like a portion of a cylinder, is arranged, in the open and in the closed position, in press-fit manner above the openings on the cartridge heads or on the cartridge walls and closes the openings in a sealed manner or to connect the openings to the passage in a sealed manner.

16. The cartridge system according to claim 8, wherein the opening of the opened compressed gas cartridge in the open position of the valve is arranged in a pressurised space that is arranged between the at least two cartridges.

17. The cartridge system according to claim 8, wherein the opening of the opened compressed gas cartridge in the open position of the valve is arranged in a pressurised space that is sealed from the surroundings in a gas-tight manner.

18. The cartridge system according to claim 11, wherein a front region of the cartridges for the cartridge content or containing the cartridge content is separated from a rear region of the at least two cartridges in a gas-tight manner.

* * * * *